US005167474A

United States Patent [19]

Kennedy et al.

[11] Patent Number: 5,167,474

[45] Date of Patent: Dec. 1, 1992

[54] FORM FOR MAKING A PERMANENT CONCRETE MINE STOPPING

[75] Inventors: John M. Kennedy; William R. Kennedy, both of Taylorville, Ill.

[73] Assignee: John Kennedy Metal Products & Buildings, Taylorville, Ill.

[21] Appl. No.: 804,892

[22] Filed: Dec. 6, 1991

[51] Int. Cl.[5] ..... E21D 9/14; E21F 5/00

[52] U.S. Cl. ..... 405/132; 405/144; 405/150.1

[58] Field of Search ..... 405/132, 144, 150.1, 405/287, 288; 249/10, 11; 299/11, 12

[56] References Cited

U.S. PATENT DOCUMENTS

| | | | |
|---|---|---|---|
| 3,302,343 | 2/1967 | Bear | 405/132 X |
| 4,036,024 | 7/1977 | Dreker et al. | 405/132 |
| 4,294,563 | 10/1981 | Kilburn | 405/132 |
| 4,329,089 | 5/1982 | Hilfiker et al. | 405/287 X |
| 4,478,535 | 10/1984 | Kennedy et al. | 405/132 |
| 4,483,642 | 11/1984 | Kennedy et al. | 405/132 |
| 4,784,522 | 11/1988 | Mraz | 405/132 |

*Primary Examiner*—David H. Corbin

*Attorney, Agent, or Firm*—Senniger, Powers, Leavitt & Roedel

[57] ABSTRACT

A form for making a permanent mine stopping of pourable and hardenable material such as concrete. The form comprises two sets of elongate extension panels, each set including a plurality of panels which may be erected to extend vertically in side-by-side relation from the floor to the roof of a passageway in a mine. When erect, the two sets of panels form two generally vertical walls spaced from one another to define a space to be filled with a pourable and hardenable material to form the stopping. Each panel comprises a pair of elongate sheet metal members having a telescoping sliding fit with one another to permit adjustable extension of the panel to fit the height of the passageway. Tie bars hold the walls of the form in spaced, generally parallel relation prior to, during and immediately after filling of the space between the walls with the pourable and hardenable material.

15 Claims, 7 Drawing Sheets 3A
3A
30
71'
71'
29A
29A
28
28
31A
15
15
41
54'
63'
63'
57'
57'
15
15
31A
41
71'
71'
30
29A
3A
3A
29A
30
B

FORM FOR MAKING A PERMANENT CONCRETE MINE STOPPING

SUMMARY OF THE INVENTION

This invention relates generally to mine stoppings, and more particularly to the installation of a permanent concrete mine stopping (sometimes referred to in the trade as a mine "seal").

Areas of a mine no longer being worked are usually permanently sealed off from other areas actively being mined. This is accomplished by constructing a heavy duty mine stopping at the entrance of a mine passage to be sealed off. The stopping, which is often required to be highly resistant to explosion, is typically made of concrete blocks or, less frequently, of poured concrete. However, these constructions have certain drawbacks. For example, stoppings constructed of concrete blocks have inherent lines of weakness between the blocks, thereby decreasing the explosion resistance and overall strength of the wall. While a poured concrete stopping overcomes this problem, special forms for the concrete must be fabricated, resulting in high installation costs.

There is a need, therefore, for a more cost effective and efficient way to construct a permanent mine stopping or seal.

Among the several objects of this invention may be noted the provision of a unique form which can be used to make a poured-concrete permanent mine stopping or seal; the provision of such a form which is quick and easy to erect and which is readily adjustable to fit passageways of different heights and widths; the provision of such a form which can readily be stripped away from the concrete after it has hardened for reuse of most components of the form; the provision of such a form the components of which are economical to make and durable so that they may be reused many times; and the provision of such a form which may be adapted to permit installation of a door frame to provide a passage through the concrete stopping, and explosion resistant covers for the frame to close opposite ends of the passage.

In general, a form of this invention is adapted for making a permanent mine stopping of pourable and hardenable material such as concrete. The form comprises two sets of elongate extensible panels, each set including a plurality of panels adapted to be erected to extend vertically in side-by-side relation from the floor to the roof of a passageway in a mine. The two sets of panels are adapted to be erected with the panels of one set constituting a first generally vertical wall of the form and the panels of other set constituting a second generally vertical wall of the form generally parallel to and spaced from the first wall to define a space to be filled with said pourable and hardenable material to form the stopping. Each panel comprises a first elongate sheet metal member constituting a lower member of the panel adapted for engagement of its lower end with the floor of the passageway, and a second elongate sheet metal member constituting an upper member of the panel adapted for engagement of its upper end with the roof of the passageway. The members have a telescoping sliding fit with one another to permit adjustable extension of the panel to fit the height of the passageway. Means is provided for holding the walls in spaced, generally parallel relation prior to, during and immediately after filling of the space between the walls with said pourable and hardenable material.

Other objects and features will be in part apparent and in part pointed out hereinafter.

BRIEF DESCRIPTION OF THE DRAWINGS

FIG. 1 is an elevation of a form of this invention for making a permanent mine stopping of concrete or the like;

Corresponding reference numerals designate corresponding parts throughout the several views of the drawings.

DETAILED DESCRIPTION OF PREFERRED EMBODIMENT

Figure 1:
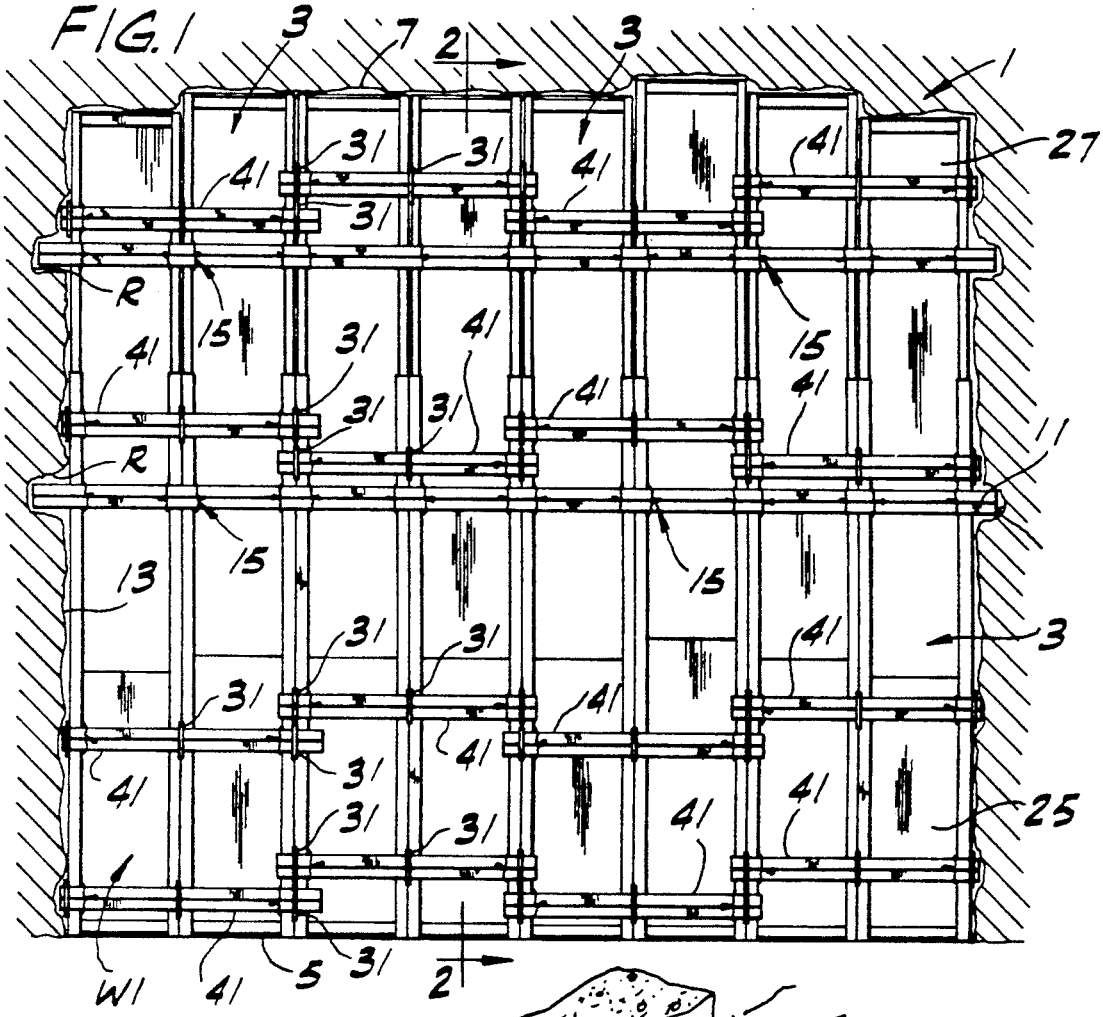
Figure 2:
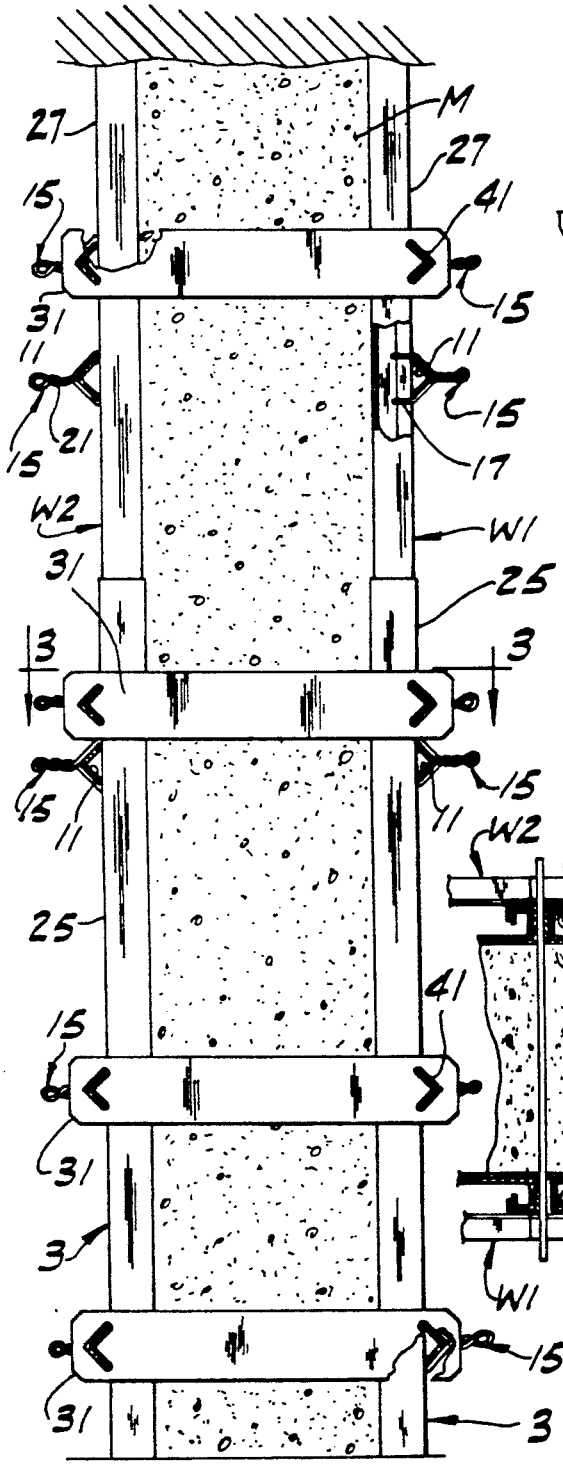
FIG. 2 is a vertical section take on line 2—2 of FIG. 1, parts being broken away to illustrate details of the form.
Figure 3:
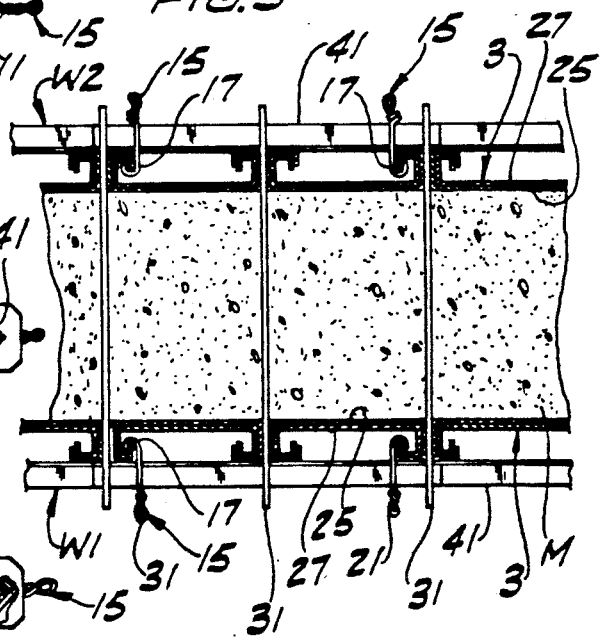
FIG. 3 is a horizontal section on line 3—3 of FIG. 2.

Referring now to the drawings, and first to FIGS. 1-3, a form for making a permanent mine stopping or seal S of pourable and hardenable material M is indicated in its entirety by the reference numeral 1. The stopping material may be concrete or other suitable commercially available material sufficiently strong when hardened to provide a permanent stopping to seal off an unworked portion of a mine.

The form comprises two sets of elongate extensible panels, each generally designated 3, of the type described in applicants' U.S. Pat. No. 4,483,642, which is incorporated herein by reference. Each set of panels includes a plurality of panels adapted to be erected to extend vertically in side-by-side relation as shown in FIG. 1 from the floor 5 to the roof 7 of a passageway in a mine. As best illustrated in FIG. 2, the two sets of panels 3 are adapted to be erected with the panels of one set constituting a first (front) generally vertical wall W1 of the form and the panels of the other set constituting a second (back) generally vertical wall W2 of the form generally parallel to and spaced from the front wall W1 to define a space to be filled with the pourable and hardenable stopping material M (FIG. 2 shows the form after the material M has been poured between the front and back walls). The spacing between the two walls W1, W2 corresponds to the thickness of the finished stopping, which will vary according to circumstances (e.g., 18"-24" thick, typically).

Each wall W1, W2 of the form further comprises a plurality of support bars 11 (two being shown) extending substantially horizontally between ribs 13 at opposite sides of the mine passageway, the ends of the bars being received in recesses R in the ribs. As described in detail in the aforementioned U.S. Pat. No. 4,483,642, the panels 3 making up the wall are secured to these bars 11 by a plurality of U-shaped wire ties 15, each tie having a hook 17 at each end engageable with one of the panels and a central portion 21 adapted to be twisted so as to deform the tie around the bar to hold the respective panel 3 in engagement with the bar. Preferably, each support bar 11 comprises two or more steel angles, one angle overlapping another at their inner end margins, the angles being secured together by ties 15 at said inner end margins thereof.

Each of the panels 3 comprises a first elongate member 25 constituting a lower member of the panel adapted for engagement of its lower end with the floor of the passageway (as shown in FIG. 1), and a second elongate member 27 constituting an upper member of the panel adapted for engagement of its upper end with the roof of the passageway. Each panel member 25, 27 is a sheet metal member of channel shape in cross section, having a web 28 and flanges 29 at opposite sides of the web. As shown in FIG. 3, each flange has an inturned portion 29A at its outer edge extending generally parallel to the web and a lip 30 at the inner edge of the inturned portion extending toward the web. The upper and lower panel members 25, 27 have a telescoping sliding fit with one another to permit adjustable extension of the panel to fit the height of the passageway. The panel members 25, 27 are secured in adjusted position to a support bar 11 by hooking the hook ends 17 of two wire ties 15 onto the lips 30 of the telescoped panel members, and then twisting the central portions 21 of the ties to clamp the upper and lower members of each panel in fixed position relative to one another. Reference may be made to U.S. Pat. No. 4,483,642 for further detail as to the construction and use of these panels 3. When erect, the panels 3 making up the front and back walls W1, W2, of the form should be oriented so that the channel defined by each panel opens outwardly away from the inside of the form. In other words, the webs 28 of the channel-shaped panels should face inwardly toward the stopping to be fabricated so that the panel webs define smooth opposing planar surfaces for contact with the stopping material when it is poured into the form, as shown in FIG. 3.

Figure 4:
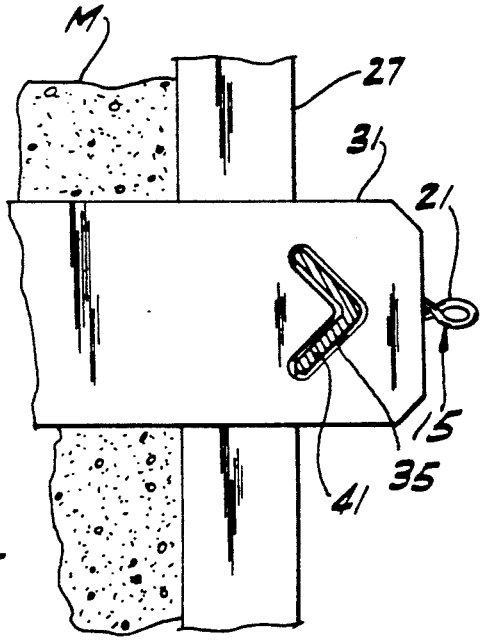
FIG. 4 is an enlarged part of FIG. 2 showing a tie bar and bracing bar of this invention.

The form 1 also includes means comprising a plurality of tie bars, each designated 31, for holding the front and back walls W1, W2 of the form in spaced, generally parallel relation prior to, during and immediately after filling of the space between the walls with concrete (or other suitable pourable and hardenable material). These tie bars 31 are formed from sheet metal (e.g., 12 ga. steel), are generally rectangular in shape, and extend generally horizontally between the walls of the form, each bar having a length greater than the spacing between the walls W1, W2 so that the ends of the bar extend endwise outwardly through openings in the walls formed by gaps between adjacent panels 3 of the walls (the gaps between adjacent panels are sufficiently wide to enable passage of the relatively thin tie bars, but sufficiently narrow to substantially prevent the escape of material having a high viscosity, such as concrete). The end of each tie bar 31 has a chevron-shaped opening or slot in it, as indicated at 35 in FIG. 4, the chevron being disposed with its apex generally in the central longitudinal axis of the bar and pointing toward its respective end of the bar. The tie bars 31 are arranged in groups of three, for example, with the openings 35 in the tie bars of each group being in horizontal alignment for reasons which will become apparent. The tie bars of each group are preferably spaced at panel-width intervals, as shown in FIG. 1.

The tie bars 31 are secured to the front and back walls W1, W2 of the form by means of braces 41 constituted by horizontal steel angles having a cross sectional shape corresponding to that of the chevron-shaped slots 35 in the ends of the tie bars. The arrangement is such that a single brace 41 on the outside of the front wall W1 is adapted to extend through aligned openings 35 in the forwardly protruding ends of the tie bars 31 of a single group of tie bars, and another brace 41 on the outside of the back wall W2 is adapted to extend through aligned openings 35 in the rearwardly protruding ends of the same group of tie bars. The braces 41 are secured to the panels 3 in suitable fashion, as by the wire ties 15 described above, with each brace bar oriented so that its legs are engageable with the inturned portions 29A of the flanges 29 of adjacent panels as shown in FIGS. 2 and 3. The length of each brace 41 will depend on the number and spacing of the ties bars 31 in each group. However, as depicted in FIG. 1, each brace 41 has a length greater than the combined widths of two adjacent panels so that it may secure at least three tie bars 31 spaced at panel-width intervals. It will be understood that the number of tie bars 31 in each group, the lengths of the braces 41, and the arrangement of the groups of the tie bars may vary without departing from the scope of this invention. The important criteria is that the tie bars 31 and braces 41 be so located and arranged as to provide the panel rigidity and support necessary for withstanding the pressures involved during the pouring and hardening process. It will be noted in this regard that the tie bars 31 should be used more frequently toward the bottom of the form, since the hydraulic pressures involved at this location are the greatest. The tie bars 31 also provide limited structural reinforcement to the concrete after it has hardened.

Figure 5:
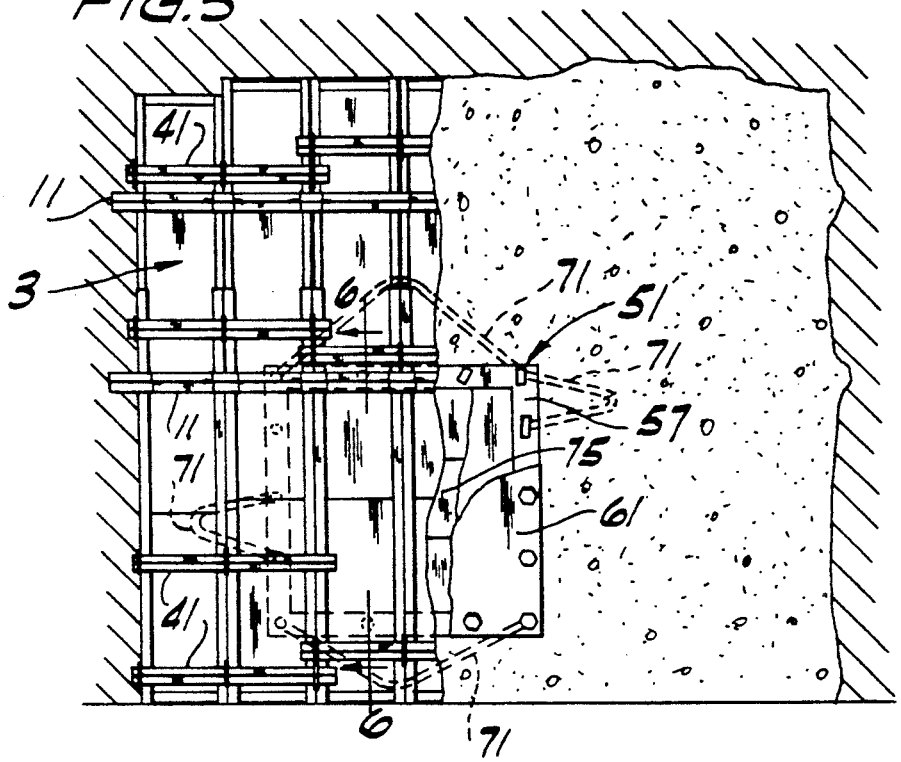
FIG. 5 is a front elevational view of the form after the stopping material has been poured, part of the front wall of the form being broken away for purposes of illustration, and further showing a door frame installed in the stopping.
Figure 7:
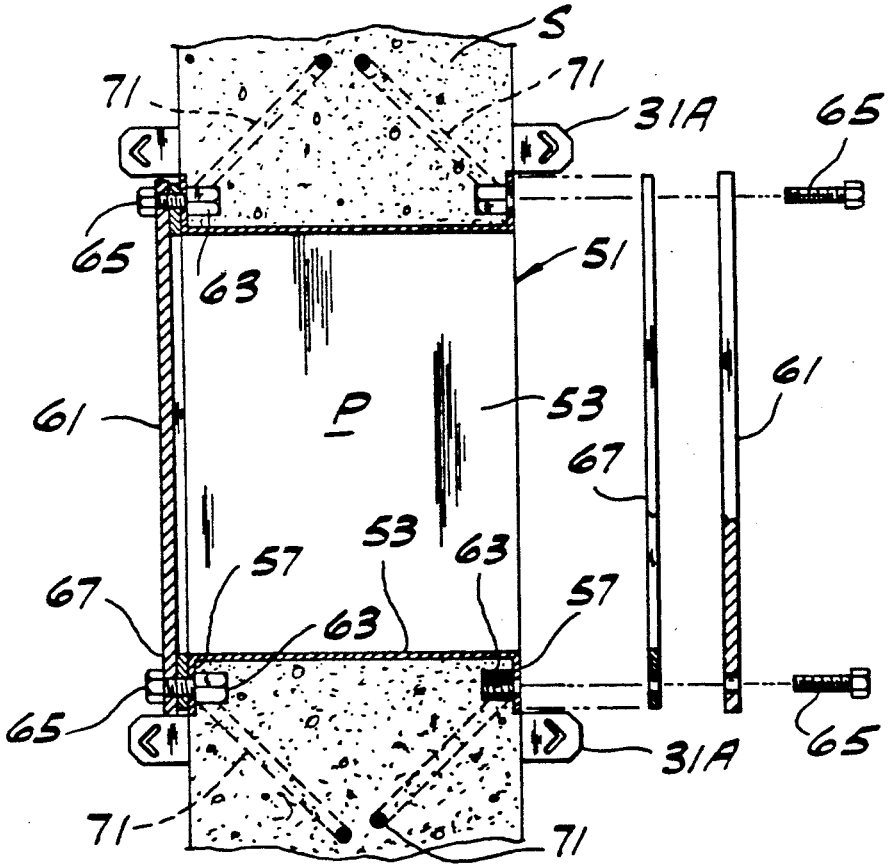
FIG. 7 is a sectional view showing the door frame (with covers) installed in a finished mine stopping.
Figure 6:
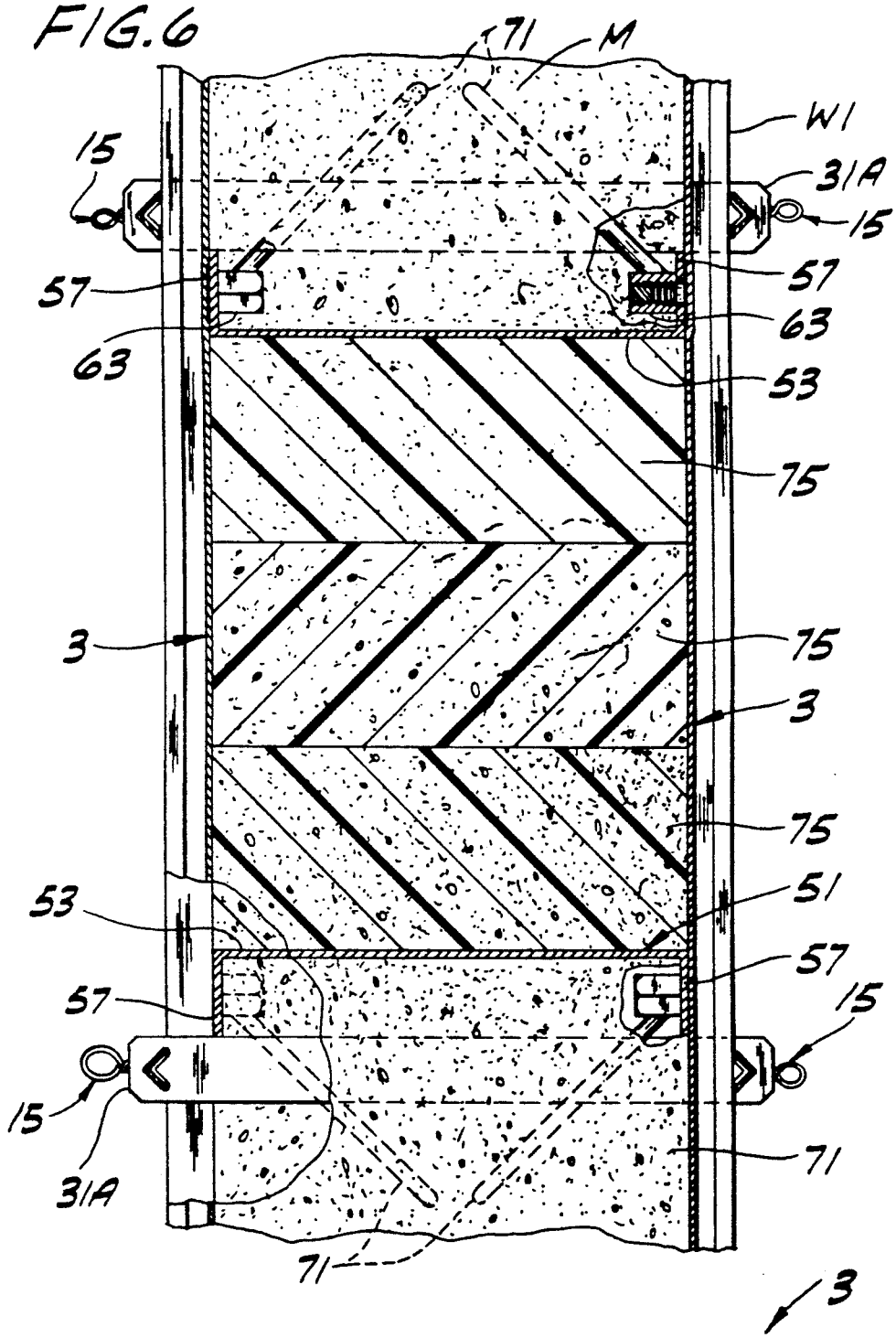
FIG. 6 is an enlarged vertical section on line 6—6 of FIG. 5 showing the door frame as installed in the stopping immediately after the stopping material has been poured, the frame being shown filled with a temporary and removable filler material to prevent the frame from becoming filled with stopping material.
Figure 3A:
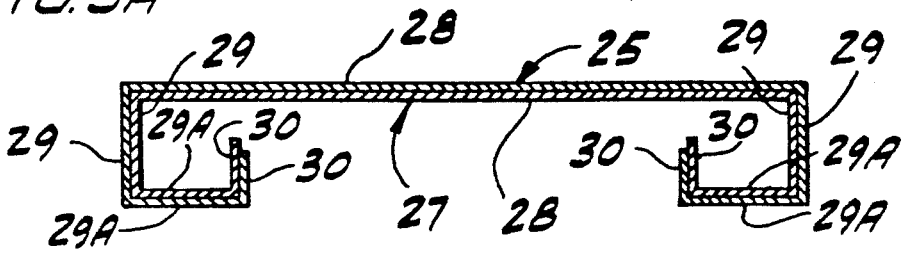
FIG. 3A is an enlarged portion of FIG. 3 showing the cross-sectional configuration of an extensible panel.

FIGS. 5-7 illustrate an annular metal frame, generally designated 51, which is adapted to be positioned between the walls W1, W2 of the form to define a passageway P having a length generally equal to the distance between the walls W1, W2, the result being a passageway or doorway through the stopping after it has been poured. The frame 51 is rectangular and comprises four channel members 53 secured to one another, as by welding, with the channels opening outwardly and defining the top, bottom, and opposite sides of the passageway P. As illustrated in FIG. 7, when the stopping S is complete, the outer peripheral flanges 57 of the frame 51 are generally flush with the exposed vertical faces of the stopping. Rectangular metal covers 61 are removably fastened to the frame at opposite ends of the passageway P by explosion-resistant means comprising a plurality of first fastener parts (e.g., nuts 63) affixed, as by welding, to the peripheral flanges 57 of the frame on the inside of the flanges, and a plurality of mating second fastener parts (e.g., bolts 65) extending through holes in the covers and cooperative with the first fastener parts 63 to fasten the covers to the frame to close both ends of the passageway P. Annular gaskets 67 are sandwiched between the covers 61 and the flanges 57 of the frame to provide a sealing fit. To strengthen the fasteners against failure in the event of an explosion, reinforcing members 71 in the form of steel rods are welded or otherwise suitable affixed to the nuts 63 and extend therefrom into the space occupied by the concrete so that after the stopping material is poured and hardens, the reinforcing members 71 and nuts 63 are surrounded by the hardened stopping material, which substantially increases the pullout resistance of the fasteners. For this same reason, the nuts 63 are also preferably elongated to provide more thread engagement with the bolts 65.

Tie bars 31A are secured (e.g., spot welded) to the frame 51 in horizontal position, as shown in FIG. 6, with the tie bars spanning the front and back peripheral flanges 57 of the frame at the top and bottom of the frame. These tie bars 31A are secured at their ends to vertical panels 3 of the front and back walls W1, W2 to support the frame 51 in position before, during and immediately after the pouring of the hardenable material, as will be described in more detail hereinafter.

To make a stopping S by using the form 1 of this invention, the back wall W2 of the form is first erected in a manner described in U.S. Pat. No. 4,483,642, that is, by making holes R in the ribs of the mine passageway and inserting therein the ends of the support bars 11. One of the panels 3 is then positioned against the bars with the side of the panel in engagement with the rib 13 at one side of the passageway. Wire ties 15 are placed over the support bars 11 with the hooks 17 hooking onto the lips 30 of the panel as described in the aforementioned patent to hold the panel against the support bars. The panel 3 is then extended to move its lower end into sealing engagement with the floor 5 of the passageway, and its upper end into sealing engagement with the roof 7 of the passageway. The central portions 21 of the wire ties are then twisted to secure the panel to the support bar with the panel held in extended position. A second panel 3 is installed at the other rib 13 of the mine passageway in a manner similar to that just described. Additional panels are similarly installed in side-by-side relation between the first and second panels to form an array of panels across the entrance of the passageway. When installing each panel it is important that the lower panel member 25 be forced down into pressure engagement with the floor of the mine passageway and that the upper panel member 27 be forced up into pressure engagement with the roof of the passageway, so that when the upper and lower panel members are secured in fixed position relative to one another such pressure engagement assists in holding the panel rigid and stable. A jack of the type described in U.S. Pat. No. 4,483,642 may be used to install the panels 3 to ensure such pressure engagement.

As the back wall W2 is erected, horizontally aligned groups of tie bars 31 are mounted at appropriate locations, with the tie bars in each group being held in a position in which they project forwardly from the back wall by a brace 41 passing through the chevron-shaped openings 35 in the rearward ends of the tie bars. Each brace 41 is secured to respective panels 3 of the back wall on the rearward side of the wall by wire ties 15.

If the completed stopping is to have a passageway P through it, a frame 51 must be installed to extend between the front and back walls W1, W2, of the form. FIGS. 5-7 illustrate a first way in which to install the frame. As the back wall is erected, using extensible vertical panels 3, the frame is installed in a position where the horizontal tie bars 31A at the top and bottom of the frame extend through vertical gaps between selected panels of the back wall, and where the rear flange 57 of the frame butts up against the webs 28 of the panels. The frame may be temporarily supported in this position by placing a support under the frame or by tack welding the tie bars 31A to the panels of the back wall. With the frame so located, the tie bars 31A on the top and bottom of the frame are secured to the back wall panels 3 by means of braces 41 and wire ties 15 in a fashion similar to that described above. The same process is then repeated at the front of the frame 51 as the front wall W1 is installed.

Once both walls W1, W2 of the form have been installed, stopping material such as concrete may be poured into the space between the forms. Access to the space for pouring is preferably through a suitable gap (or gaps) between the top of a panel 3 (or panels) and the roof 7 of the passageway, the gap being due either to an irregularity in the roof or because the panel was deliberately not extended all the way up to the roof. As concrete is poured, the tie bars 31, 31A hold the panels forming the walls W1 and W2 in fixed position against outward movement away from one another. To prevent stopping material M from entering the bores of the nuts 63 on the frame 51, the ends of the bores may be taped closed and/or temporarily filled with suitable material such as grease. For the same reason, the passageway P defined by the frame is also preferably temporarily filled with suitable material (e.g., styrofoam blocks 75 in FIG. 6).

Figure 8:
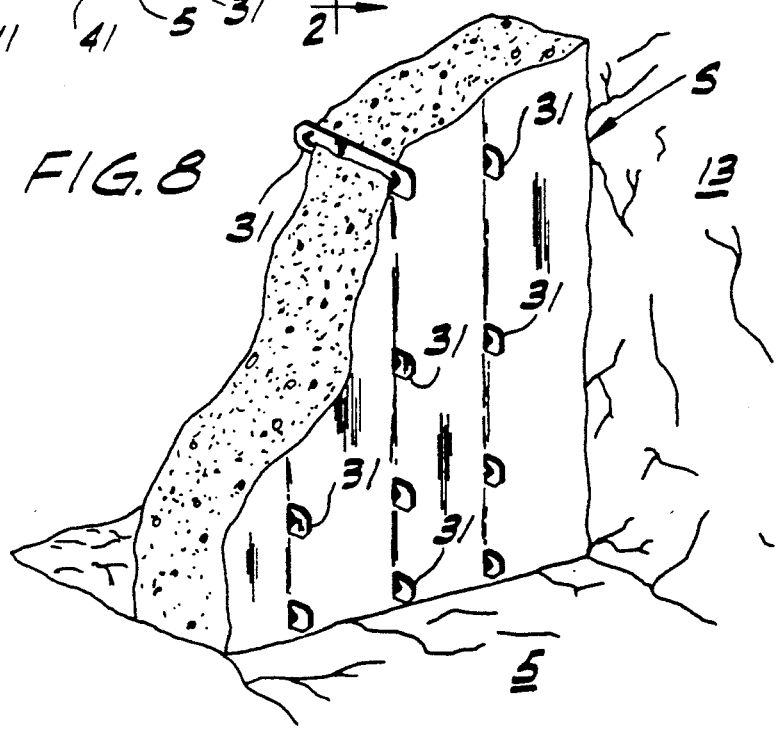
FIG. 8 is a perspective of a portion of the mine stopping after the stopping material (e.g., concrete) has hardened and the walls of the form have been removed.

After the stopping material has hardened, the panels 3, 35 may be stripped away by removing the wire ties 15, braces 41 and support bars 11, leaving a finished and permanent mine stopping S, as shown in FIGS. 7 and 8. Any gaps between the stopping S and the roof 7 of the mine passageway can be closed by applying additional stopping material. To ensure a clean separation of the panels 3 from the concrete, the surfaces of the panels in contact with the concrete may be coated with a suitable form oil or other release agent. The covers 61 (and gaskets 67) are fastened to the frame 51 (if any) after the panels have been stripped away and the filler material 75 removed from the passageway P.

Figure 9:
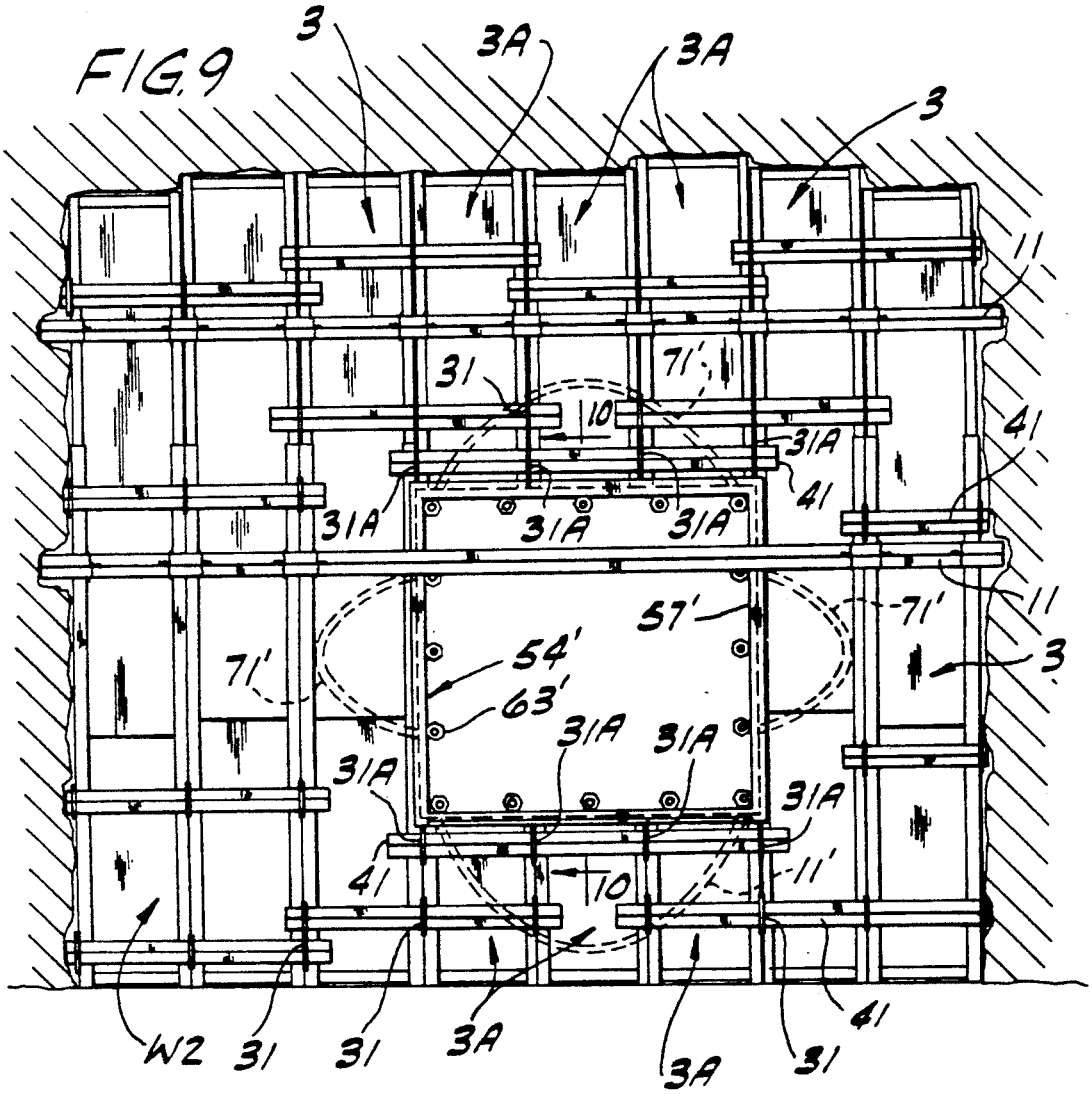
FIG. 9 is an elevational view of the back wall of the form of this invention with a door frame installed using a different technique.
Figure 10:
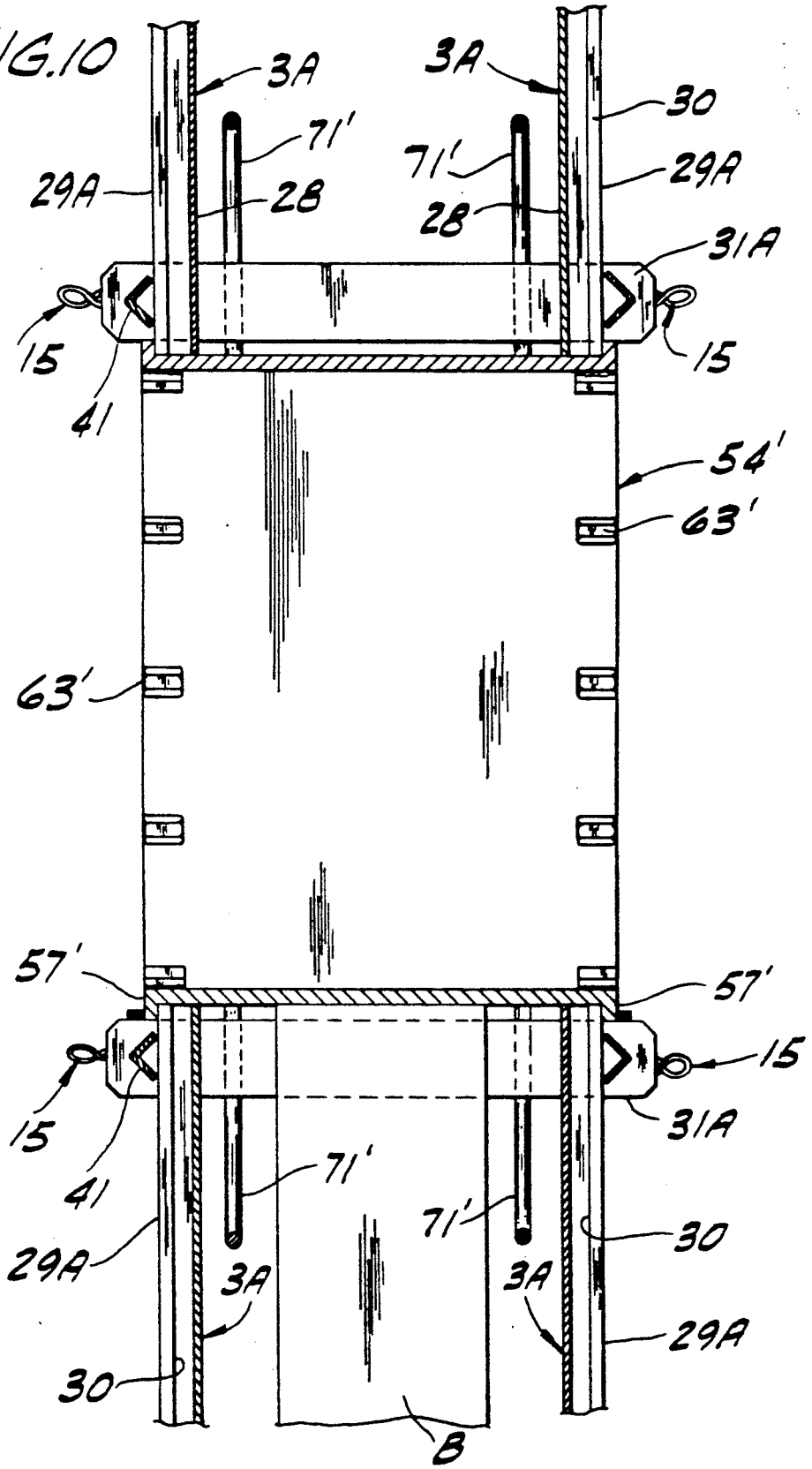
FIG. 10 is an enlarged vertical section taken on line 10—10 of FIG. 9.
Figure 11:
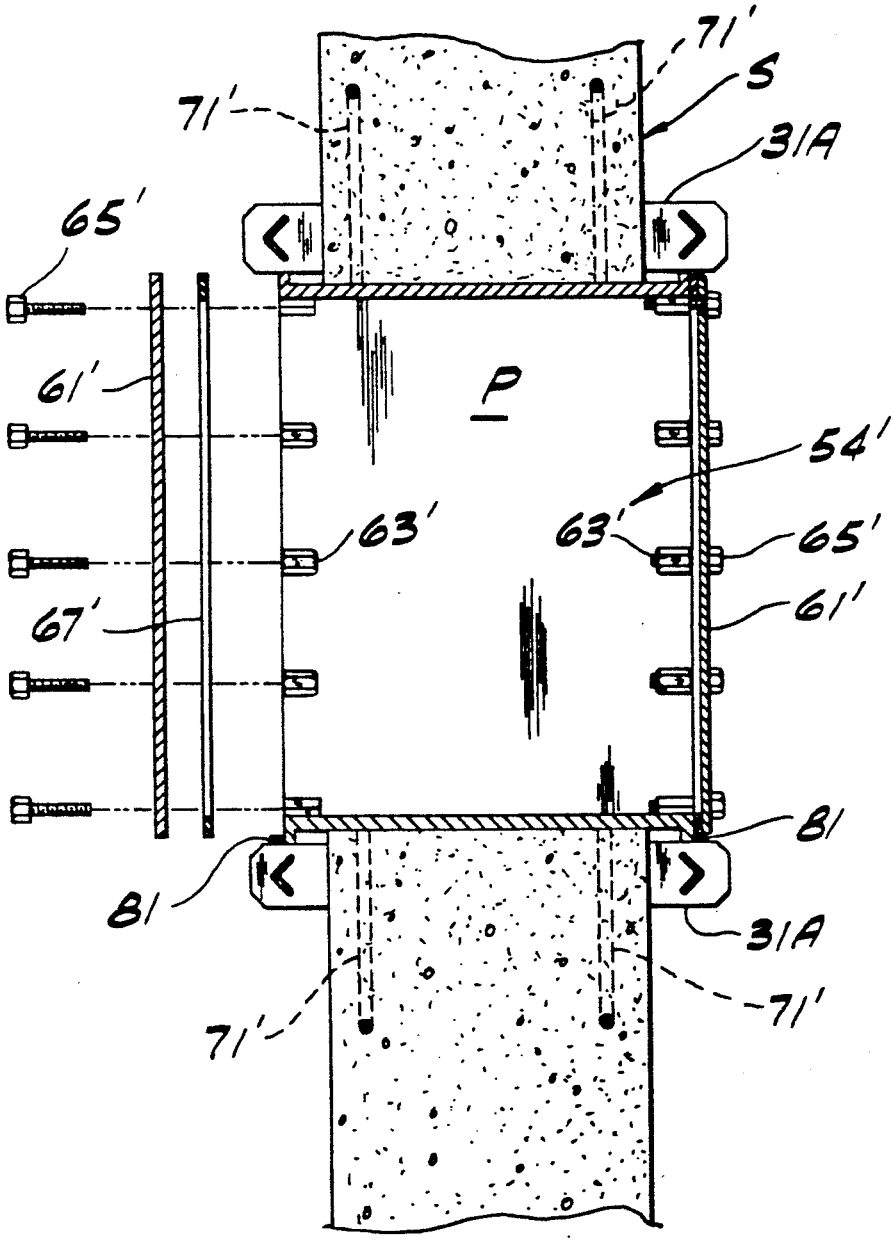
FIG. 11 is a view similar to FIG. 10 showing the completed stopping.

FIGS. 9-11 illustrate an alternative way of installing a frame 54' to provide a passageway P through the stopping S. This frame is similar to the frame 54 previously described except that the flanges 57' are narrower and the nuts 63' are affixed (e.g., welded) to the frame around the inside of the frame. Also, reinforcing members 71' are affixed directly to the frame 54' rather than to the nuts 63'. In this embodiment, the frame is installed using a series of short vertical panels 3A (instead of full-length panels) cut to the appropriate length and positioned at the bottom of the back wall at a location corresponding to the desired location of the passageway P through the stopping to be completed. A series of these short panels 3A having a combined width about equal to the width of the frame 54' are installed in side-by-side relation at the desired location. The frame is then temporarily supported, as by a concrete block B, in a position where the tie bars 31A attached to the bottom of the frame extend horizontally through gaps between adjacent panels (either adjacent short panels 3A or short panels 3A adjacent to full-length panels 3), and the bottom part of the rear peripheral flange 57' on the frame butts up against the rear faces of the inturned flange portions 29A of the panels 3, 3A, as shown in FIGS. 9 and 10. With the frame 54' so located, the tie bars 31A on the bottom of the frame are secured in fixed position to the short panels 3A and adjacent full-length panels 3 by means of braces 41 and wire ties 15 in a fashion similar to that described above. Additional short panels 3A cut to appropriate length are then installed above the frame 51 in similar fashion with the top short panels 3A reaching from the frame to the roof 7 of the mine passageway, and with the tie bars 31A secured to the top of the frame extending through gaps between these panels (or these panels and adjacent full-length panels) and secured in place by braces 41 and wire ties 15.

After the back wall W2 and frame 51 are installed, the front wall W1 is erected in similar fashion. As the front wall is erected, panels 3, 3A are installed so that the forward ends of the tie bars 31, 31A project through gaps between adjacent panels, the tie bars then being secured at their forward ends to the panels by groups of braces 41 on the outside of the front wall. After the forward ends of the tie bars 31A affixed to the frame 51 have been secured in position by braces 41 and wire ties 15, the temporary support below the frame may be removed. The tie bars 31A, braces 41 and wire ties 15 hold the frame 51 in fixed position. As shown in FIG. 9, the short panels 3A above and below the frame 54 should be rigidly connected to adjacent full-length panels 3 by groups of tie bars 31 and braces 41 to provide a rigid, stable unitary structure. After the walls W1, W2 have been erected, concrete or other suitable hardenable material may be poured, as described above. Once the material has cured, the panels 3, 3A may be stripped away, leaving a completed stopping as shown in FIG. 11. In this embodiment, the ends of the frame project outwardly a short distance beyond the stopping. Suitable covers 61' and gaskets 67' may then be attached to the frame by using bolts 65'. For the sake of convenience, support members or lugs 81 may be affixed to the lower tie bars 31A on the frame 54' for supporting the covers 61' (which may be quite heavy) in a position where the bolt holes in the covers are aligned with the nuts 63'.

It will be understood, therefore, that a form 1 of this invention is easy to install, and that standard component parts may be used despite variations in height and width of the mine passage. It will be further observed that the panels 3, 3A, braces 41 and support bars 11 are recoverable after use of the form, thereby enabling these components to be used again either in a new form or in a stopping of the type described in U.S. Pat. No. 4,483,642. In the rare instance where there is no access to the rear side of the back wall W2 of the form during installation, it is necessary to install the back wall in reverse orientation, that is, with the channels of the panels 3, 3A opening toward the inside of the form rather than away from it. In this case, the components of the back wall of the form cannot be recovered after the stopping has been poured (the components of the front wall W1, except for the tie bars 13 and the wire ties 15, are fully recoverable).

It will be understood that pourable and hardenable materials other than concrete may also be used to form the permanent mine topping or seal S of this invention. As used herein, the term "hardenable" is not intended to be restricted in meaning to a material which ultimately sets or coalesces into a body which is absolutely rigid, but rather is used in a broad sense to mean a material which ultimately assumes a permanent set regardless of whether the body so formed is rigid. For example, the body may be firm but somewhat yielding after it has set and still fall within the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A form for making a permanent mine stopping of pourable and hardenable material such as concrete, said form comprising two sets of elongate extensible panels, each set including a plurality of said panels adapted to be erected to extend vertically in side-by-side relation from the floor to the roof of a passageway in a mine, the two sets of panels being adapted to be erected with the panels of one set constituting a first generally vertical wall of the form and the panels of other set constituting a second generally vertical wall of the form generally parallel to and spaced from the first wall to define a space to be filled with said pourable and hardenable material to form said stopping, each panel comprising a first elongate sheet metal member constituting a lower member of the panel adapted for engagement of its lower end with the floor of the passageway, and a second elongate sheet metal member constituting an upper member of the panel adapted for engagement of its upper end with the roof of the passageway, said members having a telescoping sliding fit with one another to permit adjustable extension of the panel to fit the height of the passageway, and means for holding the walls in spaced, generally parallel relation prior to, during and immediately after filling of the space between the walls with said pourable and hardenable material.

2. A form as set forth in claim 1 wherein said holding means comprises a plurality of tie bars adapted to extend generally horizontally between the first and second walls of the form, each tie bar having a length greater than the spacing between said first and second walls of the form so that the ends of the bar are adapted to extend endwise outwardly through openings in the walls, and means for securing opposite ends of each tie bar to respective walls of the form thereby to prevent substantial movement of the panels away from one another before, during and immediately after pouring of material between the walls of the form.

3. A form as set forth in claim 2 wherein said securing means comprises a plurality of braces adapted to extend through openings in the ends of the tie bars, and means for securing the braces to respective panels of the walls.

4. A form as set forth in claim 3 wherein each brace is longer than the combined width of two panels so that it may extend generally horizontally through aligned openings in the ends of a group of horizontally-spaced tie bars projecting through gaps between the panels of one wall of the form.

5. A form as set forth in claim 4 wherein said braces are angle bars generally of chevron shape in cross section, and wherein the openings in the ends of the tie bars are generally of a corresponding chevron shape.

6. A form as set forth in claim 1 further comprising a frame adapted to be positioned between the walls of the form to define a passageway having a length generally equal to the distance between the walls of the form, and means for holding the frame in position before, during and immediately after pouring of said pourable and hardenable material whereby after the material has hardened, the frame defines a passage through the permanent stopping.

7. A form as set forth in claim 6 further comprising a metal cover and explosion-resistant means for securing the cover to the door frame to close one end of the passage through the stopping, said explosion-resistant means comprising a plurality of first fasteners parts rigidly affixed to the frame, reinforcing members rigidly affixed to the first fastener parts and positioned to extend into the pourable and hardenable material when the latter is poured between the walls of the form, and a plurality of second fastener parts adapted to mate with the first fastener parts to fasten the cover to the frame.

8. A form as set forth in claim 7 further comprising means for temporarily filling said frame during the pouring and hardening of said material to prevent any substantial amount of said material from entering said passageway.

9. A form for making a permanent mine stopping of pourable and hardenable material such as concrete, said form comprising two sets of elongate extensible panels, each set including a plurality of said panels adapted to be erected to extend vertically in side-by-side relation from the floor to the roof of a passageway in a mine, the two sets of panels being adapted to be erected with the panels of one set constituting a first generally vertical wall of the form and the panels of other set constituting a second generally vertical wall of the form generally parallel to and spaced from the first wall to define a space to be filled with said pourable and hardenable material to form said stopping, means for holding the walls in spaced, generally parallel relation prior to, during and immediately after filling of the space between the walls with said pourable and hardenable material, a frame adapted to be positioned between the walls of the form to define a passageway having a length generally equal to the distance between the walls of the form, and means for holding the frame in position before, during and immediately after pouring of said pourable and hardenable material whereby after the material has hardened, the frame defines a passage through the permanent stopping.

10. A form as set forth in claim 9 further comprising a metal cover and explosion-resistant means for fastening the cover to said frame to close one end of the passage through the stopping, said explosion-resistant means comprising a plurality of first fastener parts affixed to the frame, reinforcing members affixed to the first fastener parts and positioned to extend into said pourable and hardenable material when the latter is poured between the walls of the form, and a plurality of second fastener parts adapted to mate with the first fastener parts to fasten the cover to the frame.

11. A form as set forth in claim 10 wherein said frame is an annular metal frame having a peripheral flange extending laterally outwardly from the frame at one end thereof, said frame being adapted to be positioned with said flange closely adjacent one wall of the form before said pourable and hardenable material is poured between the forms, said first fastener members being affixed to the frame on the side of the flange opposite said one wall of the form, and said reinforcing members extending laterally outwardly from the frame into the space between the walls of the form to be filled with said pourable and hardenable material.

12. A form as set forth in claim 11 further comprising means for temporarily filling said frame during the pouring and hardening of said material to prevent any substantial amount of said material from entering said passageway.

13. A form as set forth in claim 9 wherein said means for holding the frame in position comprises a plurality of bars affixed to the frame and extending generally horizontally between the walls of the form, said bars being secured in fixed position adjacent their ends to respective panels of the walls.

14. A form as set forth in claim 9 wherein said frame is an annular metal frame, and reinforcing members affixed to the frame and positioned to extend into said pourable and hardenable material when the latter is poured between the walls of the form.

15. A form as set forth in claim 14 further comprising a metal cover, a plurality of first fastener parts affixed to the frame on the inside of the frame around the periphery of the frame, and a plurality of second fastener parts adapted to mate with the first fastener parts to fasten the cover to the frame.

* * * * *